US011530608B2

(12) United States Patent
Tran et al.

(10) Patent No.: US 11,530,608 B2
(45) Date of Patent: Dec. 20, 2022

(54) STAND BREAK DETECTION SYSTEMS AND METHODS

(71) Applicant: Schlumberger Technology Corporation, Sugar Land, TX (US)

(72) Inventors: James Minh Tran, Richmond, TX (US); Richard Woods, Houston, TX (US); Tania Maria Oviedo Gutierrez, Houston, TX (US); Irina Kim, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 282 days.

(21) Appl. No.: 16/794,295

(22) Filed: Feb. 19, 2020

(65) Prior Publication Data

US 2021/0254453 A1 Aug. 19, 2021

(51) Int. Cl.

| | |
|---|---|
| ***E21B 47/12*** | (2012.01) |
| ***E21B 47/26*** | (2012.01) |
| ***G06K 9/62*** | (2022.01) |

(52) U.S. Cl.
CPC ..... *E21B 47/26* (2020.05); *G06K 9/62* (2013.01)

(58) Field of Classification Search
CPC ..... G06K 9/62; E21B 19/16; E21B 21/08; E21B 21/01; E21B 47/017; E21B 7/022
See application file for complete search history.

(56) References Cited

U.S. PATENT DOCUMENTS 10,248,920 B2 * 4/2019 Hildebrand ..... G06Q 10/06312

* cited by examiner

*Primary Examiner* — Abbas I Abdulselam

(57) ABSTRACT

Aspects of the present disclosure relate to a stand break detection system. In some embodiments, the stand break detection system includes a sensor and a data processing system. The sensor may measure a movement of drill pipe as it is tripped out of a wellbore. The processor may execute instructions stored in a memory to receive measured movement data from the sensor and identify a stand break associated with one or more drill pipes using the measured movement data.

14 Claims, 13 Drawing Sheets

110

122 PIPE TALLY CORRECTION 126 128 130 132

| STAND # | PIPE LENGTH (124) | TALLY DEPTH | BIT DEPTH | OFFSET | DRIFT |
|---|---|---|---|---|---|
| 107 | 31.56 | 9,921.05 | | | |
| 107 | 31.43 | 9,952.48 | | | |
| 107 | 31.51 | 9,983.99 | 9.982.29 | –1.70 | 1.17 |
| 108 | 31.53 | 10,015.52 | | | |
| 108 | 31.50 | 10,047.02 | | | |
| 108 | 31.53 | 10,078.55 | 10.075.68 | –2.87 | –1.75 |
| 109 | 31.50 | 10,110.05 | | | |
| 109 | 31.42 | 10,141.47 | | | |
| 109 | 31.48 | 10,172.95 | 10,171.83 | –1.12 | –0.62 |
| 110 | 31.56 | 10,204.51 | | | |
| 110 | 31.45 | 10,235.96 | | | |
| 110 | 31.39 | 10,267.35 | 10,266.85 | –0.50 | –0.56 |
| 111 | 31.40 | 10,298.75 | | | |
| 111 | 31.39 | 10,330.14 | | | |
| 111 | 31.51 | 10,361.65 | 10,361.71 | 0.06 | –0.58 |
| 112 | 31.17 | 10,392.82 | | | |
| 112 | 31.62 | 10,424.44 | | | |
| 112 | 31.58 | 10,456.71 | 10,456.66 | 0.64 | –1.13 |
| 113 | 31.32 | 10,487.34 | | | |
| 113 | 31.14 | 10,518.48 | | | |
| 113 | 31.23 | 10,549.71 | 10,551.48 | 1.77 | –0.27 |
| 114 | 31.39 | 10,581.10 | | | |
| 114 | 31.58 | 10,612.68 | | | |
| 114 | 31.33 | 10,644.01 | 10,646.05 | 2.04 | 0.26 |
| 115 | 31.17 | 10,675.18 | | | |
| 115 | 31.35 | 10,706.53 | | | |
| 115 | 31.55 | 10,738.58 | 10,739.86 | 1.78 | 0.48 |
| 116 | 31.47 | 10,769.55 | | | |
| 116 | 31.52 | 10,801.07 | | | |
| 116 | 31.51 | 10,832.58 | 10,833.88 | 1.30 | 1.42 |
| 117 | 31.49 | 10,864.07 | | | |
| 117 | 31.26 | 10,895.33 | | | |
| 117 | 31.54 | 10,926.87 | 10,926.75 | –0.12 | –0.51 |
| 118 | 31.52 | 10,958.39 | | | |
| 118 | 31.53 | 10,989.92 | | | |
| 118 | 31.45 | 11,021.37 | 11,021.76 | 0.39 | –1.11 |
| 119 | 31.16 | 11,052.53 | | | |
| 119 | 31.39 | 11,083.90 | | | |

118

120

FIG. 7

STAND BREAK DETECTION SYSTEMS AND METHODS

BACKGROUND

This disclosure relates generally to measuring downhole tool conveyance and retrieval. More specifically, this disclosure relates to techniques for stand break detection and logging while tripping (LWT).

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Producing hydrocarbons from a wellbore drilled into a geological formation is a remarkably complex endeavor. During drilling operations, evaluations of the composition within the geological formation may be performed for various purposes, such as to locate hydrocarbon-producing formations and manage the production of hydrocarbons from these formations. To determine the location of hydrocarbon producing formations, as well as various geological formations, downhole tools are conveyed by various means, such as coiled tubing, drill pipe, casing or other conveyers. One or more drill pipes may be removed from the string via tripping out of the pipes.

At least in some instances, tripping out of the pipes may be used to inform certain oil and gas operations. For example, the downhole tool may include a well logging tool that measures physical properties of the geological formation at different positions of the wellbore (e.g., along a vertical and/or horizontal portion) while the drill string is being tripped out the wellbore. This process is referred to as logging while tripping (LWT). At least in some instances during LWT, the well logging tool may be a wireless well logging tool and, as such, may not be in communication with computing systems at the surface. The data obtained by such well logging tools includes measurements as a function of time. The data may be later converted to measurements as a function of position within the wellbore based on a time period that corresponds to when one or more length of pipes were raised out of the wellbore.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

One embodiment of the present disclosure relates to a system for stand break detection. The system includes a data processing system having a processor configured to execute instructions stored in a memory of the data processing system to perform actions. The actions include receiving measured movement data from at least one sensor associated with a component of a rig during a tripping process of a drill string having a plurality of drill pipes. The actions also include identifying a stand break associated with the drill pipes of the plurality of drill pipes based at least in part on the measured movement data.

Another embodiment of the present disclosure relates a method. The method includes receiving, via the processor, a first set of sensor data obtained by a first sensor disposed on a first component of a rig, wherein the first set of sensor data comprises movement data indicative of movement of the component of the rig and time data. The method also includes receiving, via the processor, a second set of sensor data obtained by a second sensor disposed on a second component of the rig, wherein the second set of sensor data comprises movement data indicative of movement of the component of the rig and the time data. Further, the method includes identifying, via the processor, a stand break based at least in part on a first portion of the first set of sensor data and a second portion of the second set of sensor data comprising movement data below a movement threshold. Further still, the method includes identifying, via the processor, a length of a drill pipe associated with at least the first portion of the first set of sensor data, the second portion of the second set of sensor data, or both, based at least in part on the stand break Another embodiment of the present disclosure relates to an article of manufacturer comprising instructions that, when executed by at least one processor, cause the at least one processor to receive a first set of data obtained by a first sensor disposed on a first component of a rig during a tripping process, wherein the first set of data comprises data indicative of a traveling block position; receive a second set of data obtained by a second sensor disposed a second component of the rig during the tripping process, wherein the second set of data comprises data indicative of a position of a drill bit of the rig; determine stand length based at least in part on the second set of data; and determine a stand break based at least in part on a comparison between the first set of data and the determined stand length.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which:

FIG. 7 is an illustrated embodiment of a table that stores information associated with one or more drill pipes of the drill string, in accordance with an embodiment of the present disclosure;

DETAILED DESCRIPTION

Figure 1:
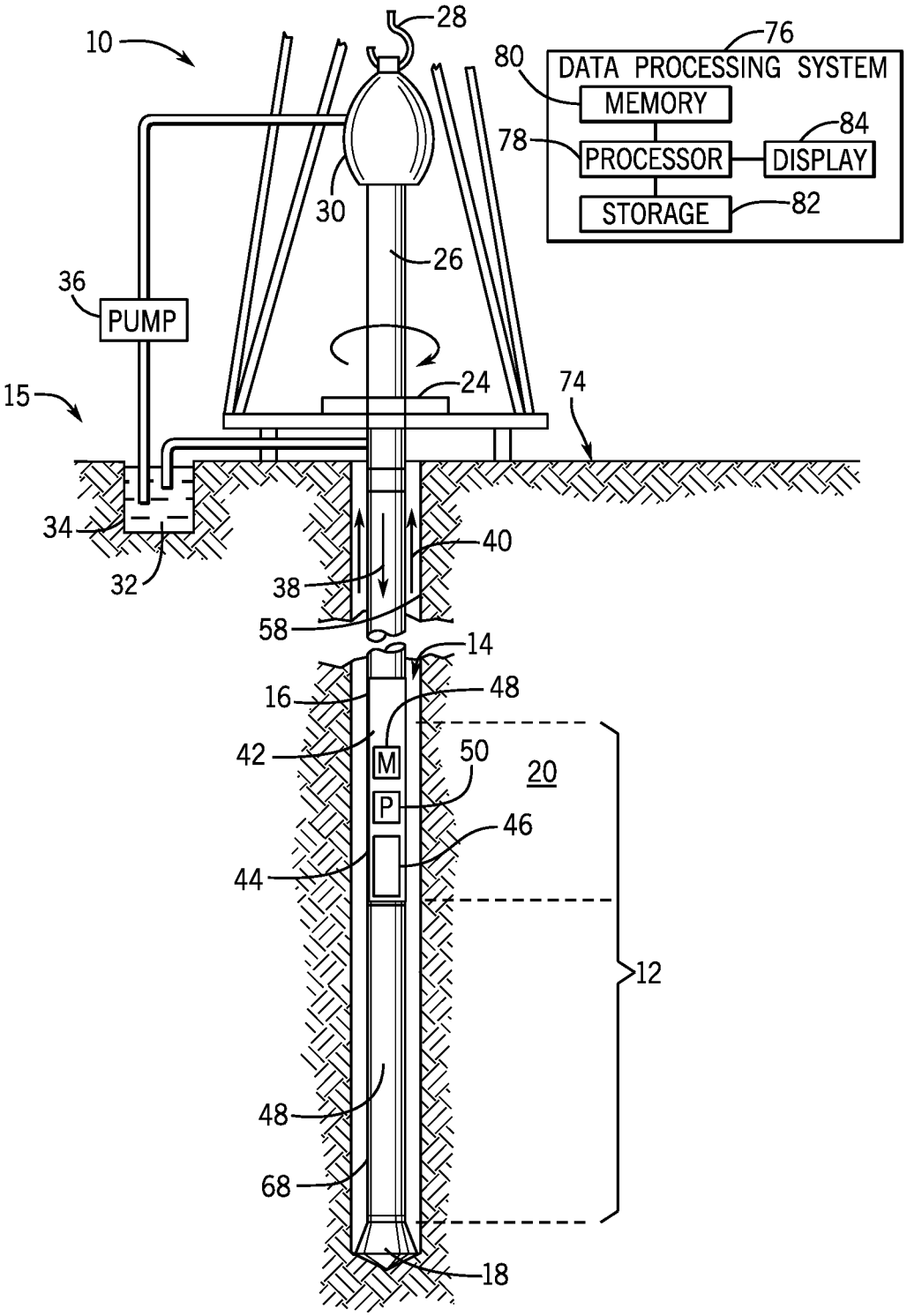
FIG. 1 is a schematic front elevation view of an embodiment of a drill rig having a well logging tool conveyed within a drill string, in accordance with an embodiment of the present disclosure.

One or more specific embodiments of the present disclosure will be described below. These described embodiments are examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would still be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

In the present context, the term "about" or "approximately" is intended to mean that the values indicated are not exact and the actual value may vary from those indicated in a manner that does not materially alter the operation concerned. For example, the term "about" or "approximately" as used herein is intended to convey a suitable value that is within a particular tolerance (e.g., ±10%, ±5%, ±1%, ±0.5%), as would be understood by one skilled in the art.

As referred to herein, "to trip" or "tripping" pipe refers to the process of pulling a drill string out of a wellbore. As referred to herein, a "drill string" is a combination of drill pipes. As referred to herein, a "stand" is two or more joints of drill pipes or drill collars that may be physically coupled (e.g., via a threaded connection) while a pipe is tripped. As referred to herein, a "stand break" is the removal of a drill pipe from at least one of the joined of the drill pipes.

Tripping drill pipes generally includes a step of raising one or more drill pipes out of the wellbore (e.g., using machinery) and an additional step of removing the one or more drill pipes from the drill string (e.g., a stand break). As mentioned above, certain operations that occur during tripping of drill pipes of the downhole tool system, such as during logging-while-tripping (LWT) operations, may have data that is based on determining times associated with, or between, the step of raising one or more drill pipes and the step of removing the one or more drill pipes from the drill string. For example, the well logging tool may be a wireless well logging tool and, as such, may not be in communication with any computing devices on the surface (e.g., via a wireline) while the wireless downhole tool is in the subsurface including the wellbore. Instead, the data associated with the measured physical properties of the surrounding geological formation is retrieved after the wireless downhole tool is removed from the wellbore at the surface. It should be noted that the data obtained by the wireless downhole tool may include one or more measurements as a function of time instead of a position (e.g., depth and/or horizontal position) because the well logging tool may not be in communication with any other computing devices at the surface. It should be appreciated that converting the one or more measurements as a function of time to one or more measurements as a function of position may better inform certain oil and gas operations, such as where to drill.

It may be difficult to convert the one or measurements as a function of time to one or more measurements as a function of position within in wellbore. In particular, it may be difficult to identify a time period during tripping associated with the raising of the one or more drill pipes out of the wellbore and the stand break, when the one or more drill pipes are removed from the drill string, as various processes occur during tripping out that may interrupt pulling out of the drill string. For example, operators and/or machines may be placing the one or more drill pipes to be removed from the drill string "in-slips". As discussed herein, "in-slips" generally refers to when the drill pipe(s) is coupled to a traveling block and raised a length approximately equal to the length of the drill pipe(s) (e.g., as discussed in further detail with regards to FIGS. 1 and 6). As such, it may be difficult to correlate measurements as a function of time obtained by sensors disposed on a drill rig to an occurrence of a stand break.

In LWT operations, the one or more measurements as a function of time may be converted into one or more measurements as a function of depth based on the time at which one or more drill pipes are tripped. That is, LWT operations, as one or more drill pipes are raised out of a wellbore and/or removed from the drill string (e.g., a stand break occurrence), the well logging tool moves a distance along the wellbore (e.g., horizontally and/or vertically) within the subsurface that is proportional to the length of the one or more drill pipes that are raised out of the wellbore. Likewise, the time period corresponding to when the one or more pipes were raised out of the wellbore during tripping of the pipes. As such, the one or more measurements as a function of time may be converted into one or more measurements as a function of position (e.g., depth) based on the time period when the one or more drill pipes are pulled out of the wellbore and/or removed from the drill string. However, tripping pipe is a complex and multi-step process, which makes converting the one or more measurements as a function of time to one or more measurements as a function of position difficult. While the above-disclosure generally relates to LWT, it should be noted that the techniques of the present disclosure generally relate to operations associated with tripping pipes.

Accordingly, the present disclosure relates to stand break detection, which may determine when one or more drill pipes are removed from the drill string. In some embodiments, the techniques may include determining a length of the one or more drill pipes that are removed and/or converting one or more measurements as function of time (e.g., obtained by a well logging tool being removed from a wellbore by the tripping out system). For example, a processor may receive sensor data from at least one sensor (e.g., 1 sensor, 2 sensors, or more) as a function of time obtained via one or more components of the tripping out system and determines characteristic features of the sensor data that are indicative of the one or more drill pipes being removed from the drill string. In some embodiments, the sensor data may be processed data from an electronic drilling recorder (EDR), which may provide an estimated measurement of a drill bit depth. The data may be processed by any suitable processing formats, such as Wellsite information Transfer Specification (WITS). In some embodiments, the techniques include correlating a detected stand break to a length of one or more drill pipes that were removed from the drill string. At least in some instances, and as discussed in more detail with regard to FIG. 7, the processor may access a table (e.g., a drill pipe identification table as discussed herein) that stores information such as a length of the one or more drill pipes of the drill string and a relative position (e.g., order) of the one or more drill pipes of the drill string, which may facilitate determination of a stand break and/or identification of a length of drill pipes removed from the drill string. Additionally, at least in some embodiments, the techniques include converting one or measurements as a function of time that were obtained during LWT operations into one or more measurements as a function of position based on the length of the one or more drill pipes that were removed. In this way, the techniques of the present disclosure may at least partially automate certain steps of the stand break detection process and/or LWT operations by determining stand breaks based on the characteristic features of the sensor data. Moreover, by at least partially automating certain steps of the stand detection process, the techniques of the present disclosure may reduce costs associated with tripping and/or LWT operations.

With the foregoing in mind, FIG. 1 depicts an examples of a wellsite system that may employ the stand break detection techniques described herein. FIG. 1 depicts a rig 10 with a downhole acquisition tool 12 suspended therefrom and into a wellbore 14 of a reservoir 15 via a drill string 16. The downhole acquisition tool 12 has a drill bit 18 at its lower end thereof that is used to advance the downhole acquisition tool 12 into geological formation 20 and form the wellbore 14. The drill string 16 is rotated by a rotary table 24, energized by means not shown, which engages a kelly 26 at the upper end of the drill string 16. The drill string 16 is suspended from a hook 28, attached to a traveling block (also not shown), through the kelly 26 and a rotary swivel 30 that permits rotation of the drill string 16 relative to the hook 28. The rig 10 is depicted as a land-based platform and derrick assembly used to form the wellbore 14 by rotary drilling. However, in other embodiments, the rig 10 may be an offshore platform.

Formation fluid or mud 32 (e.g., oil base mud (OBM) or water-based mud (WBM)) is stored in a pit 34 formed at the well site. A pump 36 delivers the formation fluid 52 to the interior of the drill string 16 via a port in the swivel 30, inducing the drilling mud 32 to flow downwardly through the drill string 16 as indicated by a directional arrow 38. The formation fluid exits the drill string 16 via ports in the drill bit 18, and then circulates upwardly through the region between the outside of the drill string 16 and the wall of the wellbore 14, called the annulus, as indicated by directional arrows 40. The drilling mud 32 lubricates the drill bit 18 and carries formation cuttings up to the surface as it is returned to the pit 34 for recirculation.

The downhole acquisition tool 12, sometimes referred to as a bottom hole assembly ("BHA"), may be positioned near the drill bit 18 and includes various components with capabilities, such as measuring, processing, and storing information, as well as communicating with the surface. A telemetry device (not shown) also may be provided for communicating with a surface unit (not shown). As should be noted, the downhole acquisition tool 12 may be conveyed on wired drill pipe, a combination of wired drill pipe and wireline, or other suitable types of conveyance.

In the illustrated embodiment of FIG. 1, a well logging tool 42 is disposed within one or more drill pipes 44 of a drill string 16. The well logging tool includes a well logging tool subsystem 46, a memory 48, and a processor 50. In operation, the well logging tool 42 may be deployed within the wellbore 14, and the well logging tool subsystem 46 may obtain one or more measurements indicative of the physical properties of the geological formation, as discussed in more detail with regards to FIGS. 2-5. In general, the well logging tool subsystem 46 may include one or more downhole devices that measure properties of the formation. For example, the well logging tool subsystem 46 may include a radiation source that emits radiation (e.g., gamma rays) into the formation 20 to determine formation properties such as, e.g., lithology, density, formation geometry, reservoir boundaries, among others. The gamma rays interact with the formation through Compton scattering, which may attenuate the gamma rays. Sensors may be included within the well logging tool subsystem 46 may detect the scattered gamma rays and determine the geological characteristics of the formation 20 based at least in part on the attenuated gamma rays. This is meant to represent just one example of a downhole well logging tool 42 that may measure properties of the formation. Indeed, the well logging tool 42 may represent any suitable downhole well logging tool that may measure properties of the geological formation. These properties may be measured as a function of time. The properties may be converted to a function of position in the wellbore 14 (e.g., depth) by automatically identifying stand breaks as the drill string 16 is tripped out of the wellbore 14.

The memory 48 of the well logging tool 42 may store the measurements obtained by the well logging tool subsystem 46 as well as control software, look up tables, configuration data, etc. The memory 48 may include a volatile memory, such as random access memory (RAM), and/or a nonvolatile memory, such as read-only memory (ROM). The memory 48 may store a variety of information and may be used for various purposes, such as the one or more measurements indicative. For example, the memory 48 may store processor-executable instructions including firmware or software for the processor 50 to execute. In some examples, the memory 48 is a tangible, non-transitory, machine-readable-medium that may store machine-readable instructions for the processor 50 to execute. The memory 48 may include ROM, flash memory, a hard drive, or any other suitable optical, magnetic, or solid-state storage medium, or a combination thereof. The memory 48 may store data, instructions, and any other suitable data. In some embodiments, the memory 48 may be included within the well logging tool subsystem 46.

The data obtained by the well logging tool 42 (e.g., well logging tool subsystem 46) and stored in the memory 48 may be retrieved and accessed by a data processing system 76 after the well logging tool 42 is retrieved from the wellbore 14. The data processing system 76 may include a processor 78, memory 80, storage 82, and/or display 84. The memory 80 may include one or more tangible, non-transitory, machine readable media collectively storing one or more sets of instructions for operating the downhole acquisition tool 12, determining formation characteristics (e.g., geometry, connectivity, minimum horizontal stress, etc.) calculating and estimating fluid properties of a reservoir fluid within the formation 20, modeling the fluid behaviors using, e.g., equation of state models (EOS). The memory 80 may store reservoir modeling systems (e.g., geological process models, petroleum systems models, reservoir dynamics models, etc.), mixing rules and models associated with compositional characteristics of the formation 20, equation of state (EOS) models for equilibrium and dynamic fluid behaviors (e.g., biodegradation, gas/condensate charge into oil, $CO_2$ charge into oil, fault block migration/subsidence, convective currents, among others), and any other information that may be used to determine geological and fluid characteristics of the formation 20.

To process the data obtained by the well logging tool 42, the processor 78 may execute instructions stored in the memory 80 and/or storage 82. For example, the instructions may cause the processor to compare the data (e.g., from the logging while drilling and/or downhole analysis) with known reservoir properties estimated using the reservoir modeling systems, use the data as inputs for the reservoir modeling systems, and identify geological and reservoir fluid parameters that may be used for exploration and production of the reservoir. As such, the memory 80 and/or storage 82 of the data processing system 76 may be any suitable article of manufacture that can store the instructions. By way of example, the memory 80 and/or the storage 82 may be ROM memory, random-access memory (RAM), flash memory, an optical storage medium, or a hard disk drive. The display 84 may be any suitable electronic display that can display information (e.g., logs, tables, cross-plots, reservoir maps, etc.) relating to properties of the well/reservoir as measured by the downhole acquisition tool 12.

Figure 2:
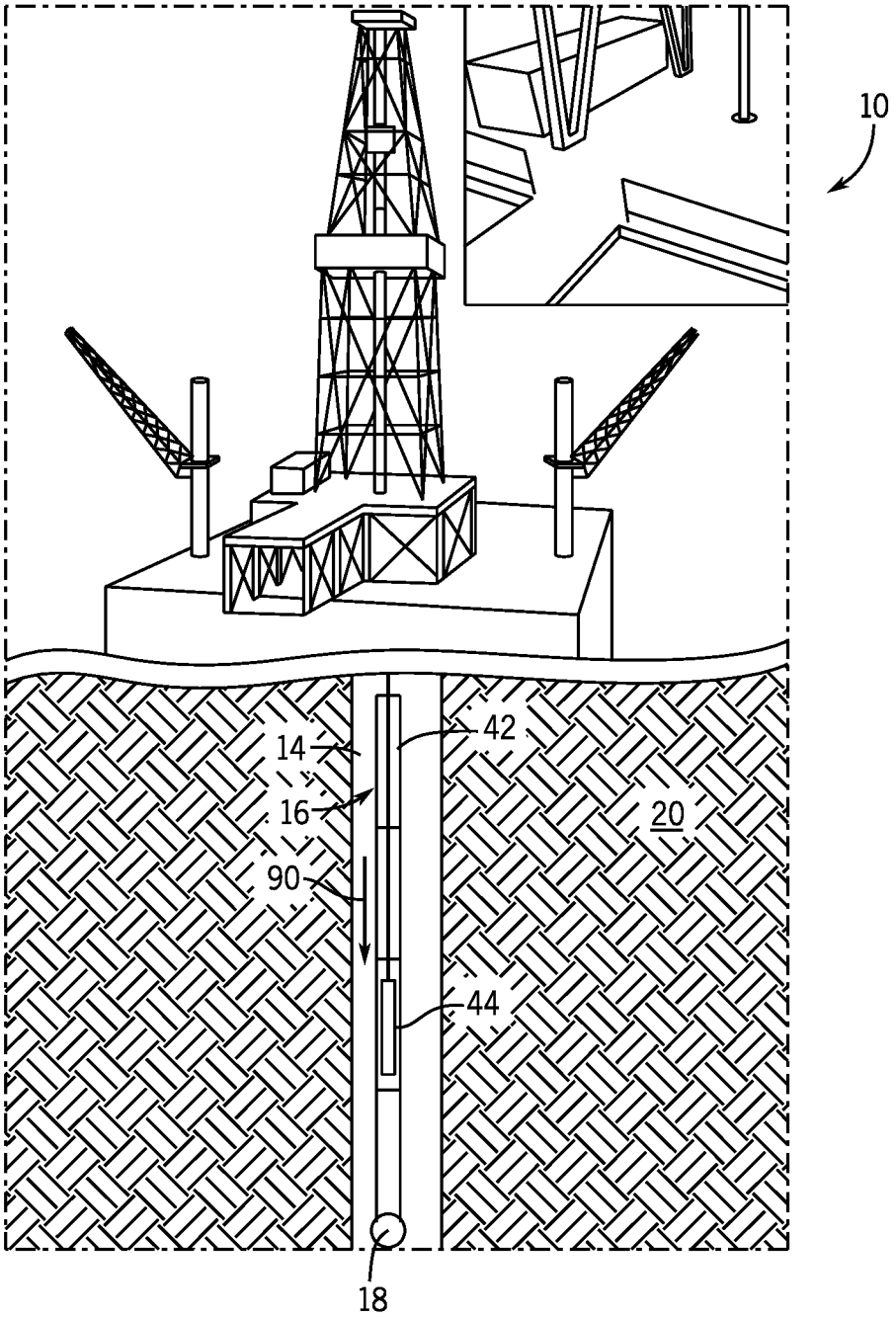
FIG. 2 is a schematic front elevation view of an embodiment of the well logging tool of FIG. 1 in a first position where the well logging tool is disposed within the drill string, in accordance with an embodiment of the present disclosure.

As mentioned above, the well logging tool 42 may be deployed within the wellbore 14 to obtain one or more measurements as a function of time indicative of physical properties of the formation 20. To illustrate the deployment of the well logging tool 42, FIG. 2 is a front perspective of an embodiment of a rig 10 having a well logging tool 42 disposed within the drill string 16 at a first position within the wellbore 14. In particular, the drill bit 18 of the downhole acquisition tool 12 has drilled to a suitable depth (e.g., as indicated by the arrow 90). As shown in the illustrated embodiment, the well logging tool 42 is within the drill string 16 and, as such, may not be activated (e.g. obtaining measurements indicative of the physical properties of the geological formation). In the illustrated embodiment, the wireless well logging tool 42 is retrievably suspended by suitable means, such as by the cable 92. It should be noted that the well logging tool 42 may still be able to receive commands with the surface (e.g., communicate with the data processing system 76) while the well logging tool 42 is coupled to the cable 92.

Figure 3:
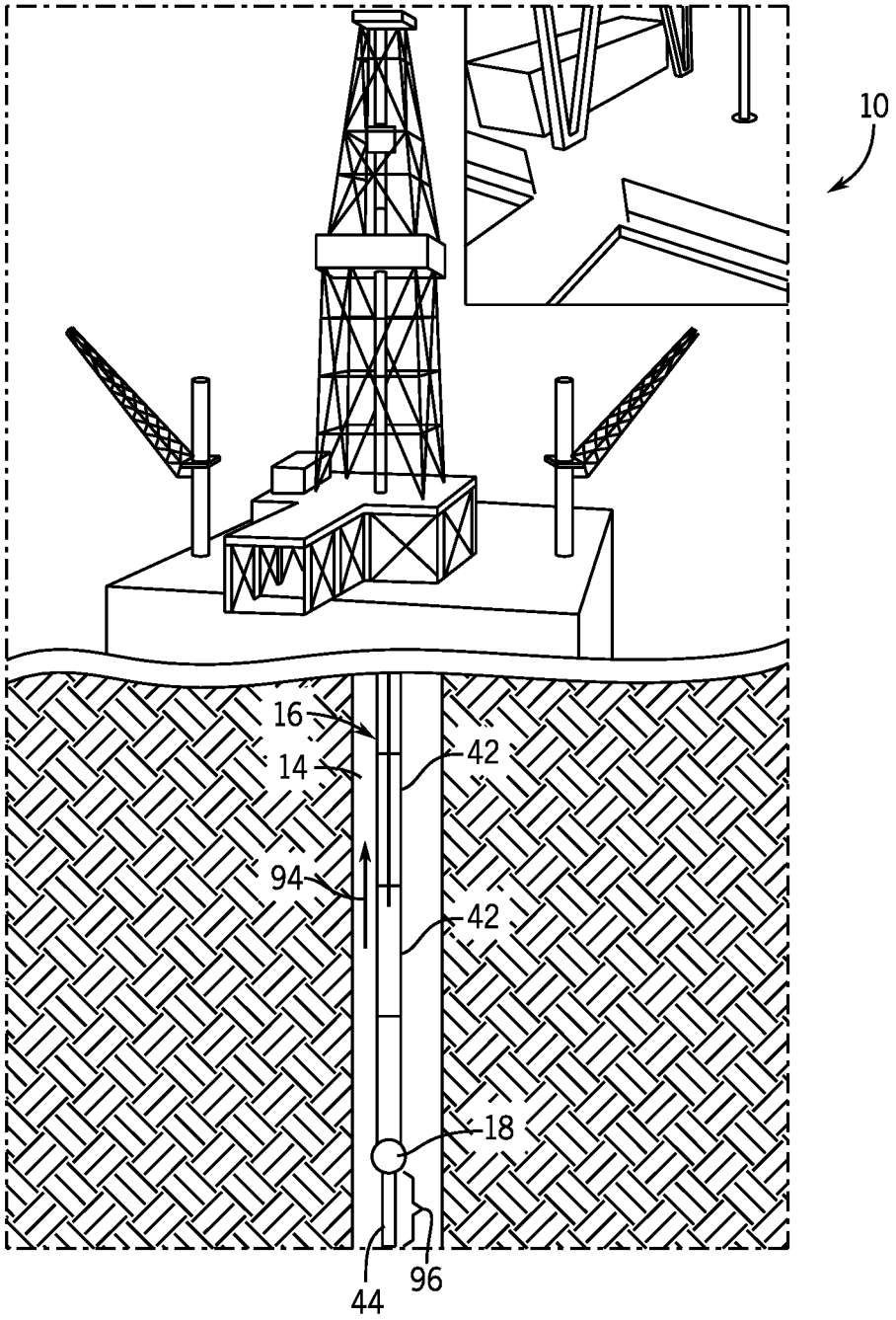
FIG. 3 is a schematic front elevation view of an embodiment of the well logging tool of FIG. 1 in a second position where the well logging tool is being deployed within the wellbore, in accordance with an embodiment of the present disclosure.

In FIG. 3 is a front perspective view of an embodiment of the rig 10 with a well logging tool 42 at a second position within the wellbore 14. In particular, the downhole acquisition tool 12 has moved longitudinally upwards (e.g., in the direction 94) from the bottom of the wellbore such that there is sufficient space 96 for the well logging tool 42 to be deployed within the wellbore 14 (e.g., greater than or equal to a length of the well logging tool that extends into the wellbore). Once there is sufficient space for the well logging tool 42, the well logging tool 42 may be lowered within the drill pipes 44 of the drill string 16 via gravity.

As shown in the illustrated example, the well logging tool 42 is deployed (e.g., removed from the drill string 16). That is, the well logging tool 42 is no longer within one or more drill pipes 44 of the drill string 16 and, instead, the well logging tool 42, or at least a portion of the well logging tool 42, is extending into the wellbore 14 and coupled to the drill bit 18 of the downhole acquisition tool 12. It should be noted that the well logging tool 42 may be checked for functionality while the well logging tool 42 is still attached to the cable 92 and/or still within the drill casing 16 via communication with the data processing system 76. In any case, the well logging tool 42 may be activated to begin collecting measurements as a function of time and be released from the cable 92.

Figure 4:
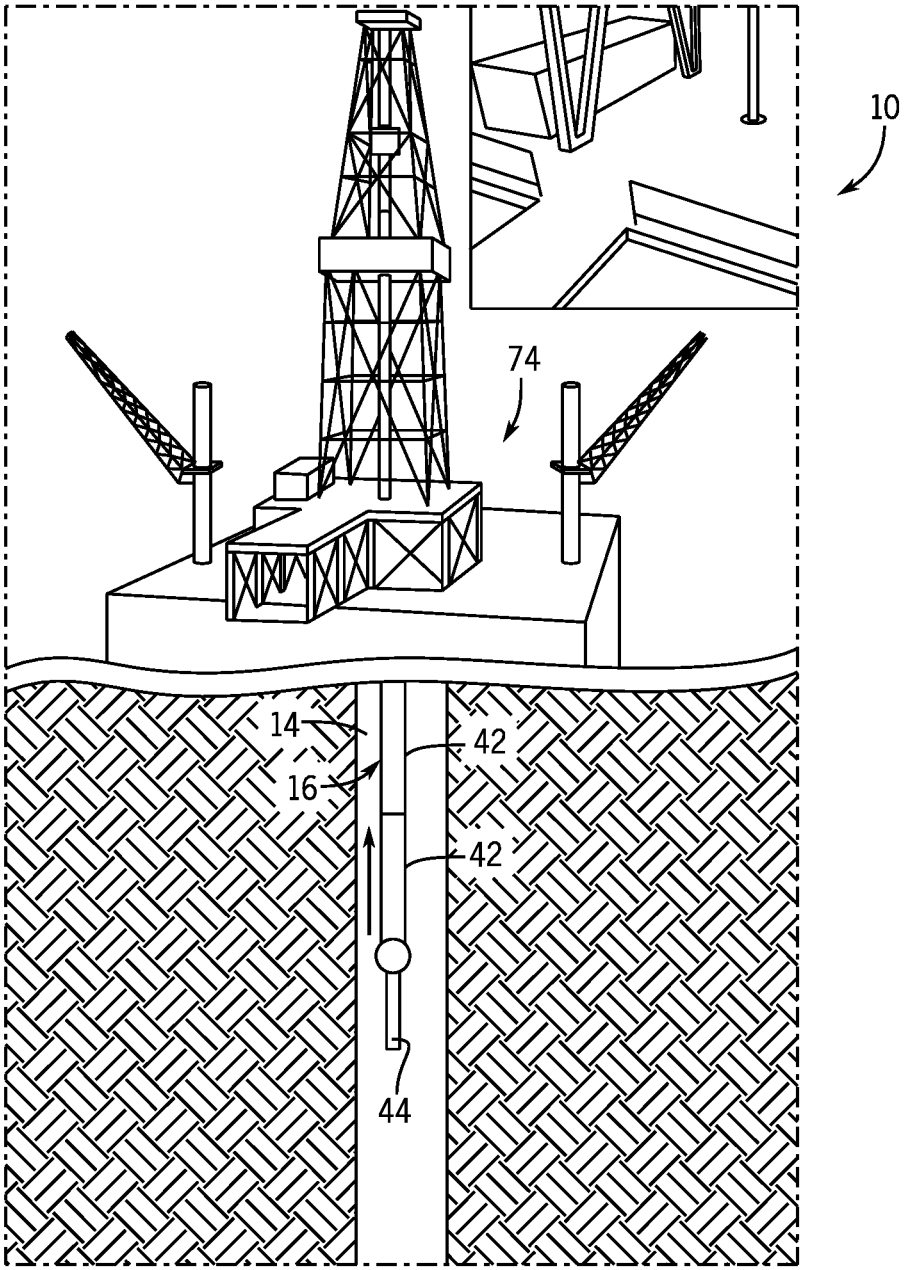
FIG. 4 is a schematic front elevation view of an embodiment of the well logging tool of FIG. 1 in a third position where the well logging tool is being retrieved from the wellbore during tripping out of the drill string, in accordance with an embodiment of the present disclosure.

FIG. 4 is a front perspective view of an embodiment of a drill system 10 with a well logging tool 42 at a third position within the wellbore 14. In particular, the well logging tool 42 has moved a distance 98 from the second position illustrated in FIG. 3. At least in some instances, the well logging tool 42 may be moving because one or more drill pipes 44 are being raised out of the drill string 16. As such, the distance 98 may be proportional to a length of the one or more drill pipes 44 of the drill string 16 that were raised out the wellbore 14 before being removed at the surface during the tripping process. Moreover, when the well logging tool 42 is activated and, thus, obtaining measurements (e.g., continuously or periodically) of the formation 20 as a function of time, a time period corresponding to when the well logging tool 42 moved the distance 98 may be determined based at least in part on the length of the one or more drill pipes 44 that were removed.

Figure 5:
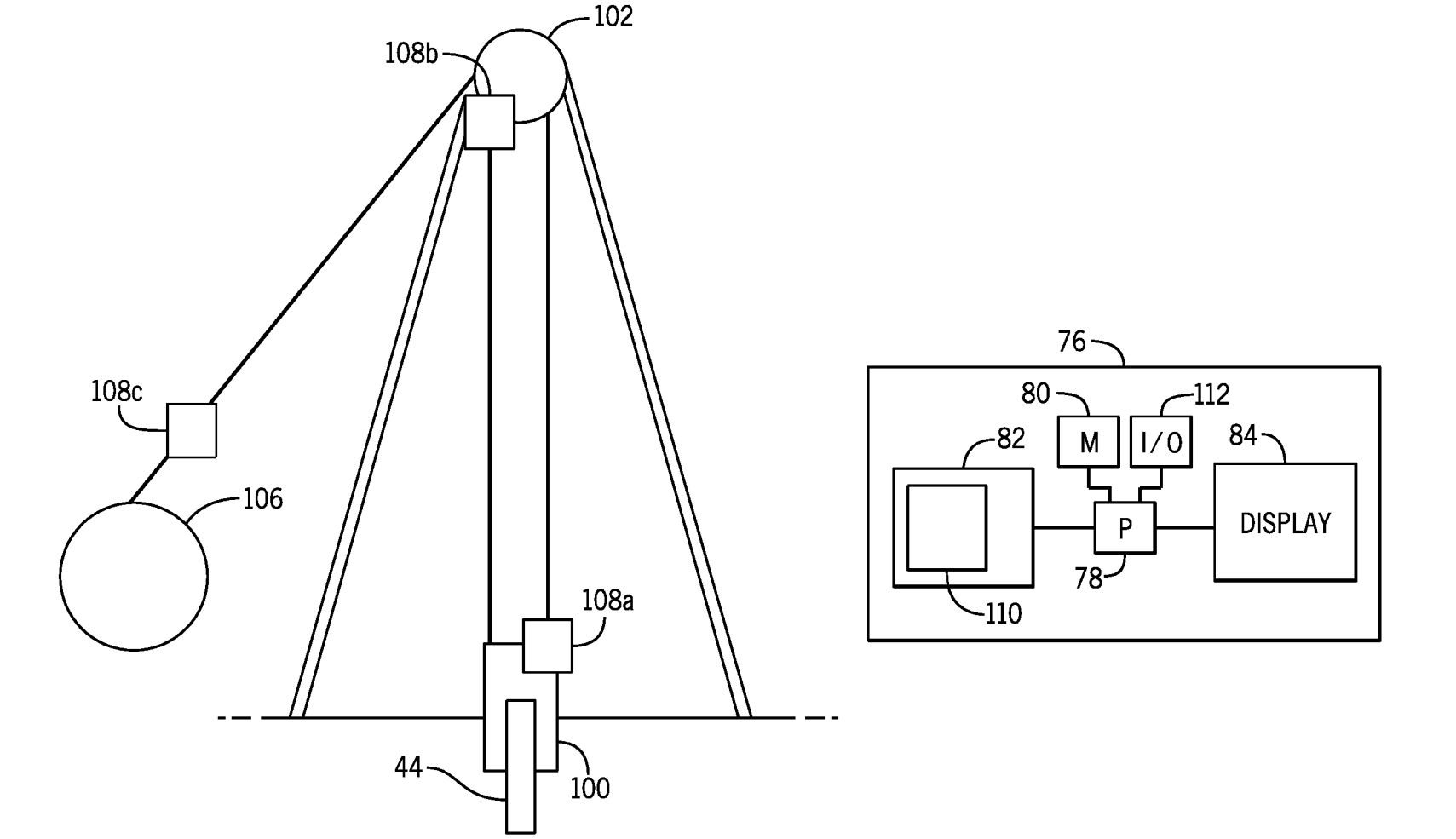
FIG. 5 is a schematic front elevation view of an embodiment of the drill rig of FIG. 1 at a first time point during tripping out of the drill string, in accordance with an embodiment of the present disclosure.

To better illustrate how the techniques of the present disclosure may facilitate determination of a stand break (e.g., the time period when one or more drill pipes 44 were removed from the drill string 16), FIG. 5 is a front perspective view of an embodiment of the rig 10 at first time point before a drill pipe 44 has been removed from the wellbore 14. As shown in the illustrated embodiment, the drill pipe 44 is coupled to a traveling block 100 (e.g., via the hook 28 shown in FIG. 1) and, therefore, is "in-slips". The traveling block 100 is moveably coupled to a crown block 102 via a drill line 104, and the drill line 104 is also be moveably coupled to a draw works 106. As it may be understood by one of ordinary skill in the art, in operation, the draw works 106 raises and lowers the traveling block 100, which causes the drill pipes 44 to move into, out of the wellbore 14, and/or to a height above the wellbore 14, and the drill pipes 44 are subsequently removed from the drill suing 16 by one or more operators and/or machines.

Figure 6:
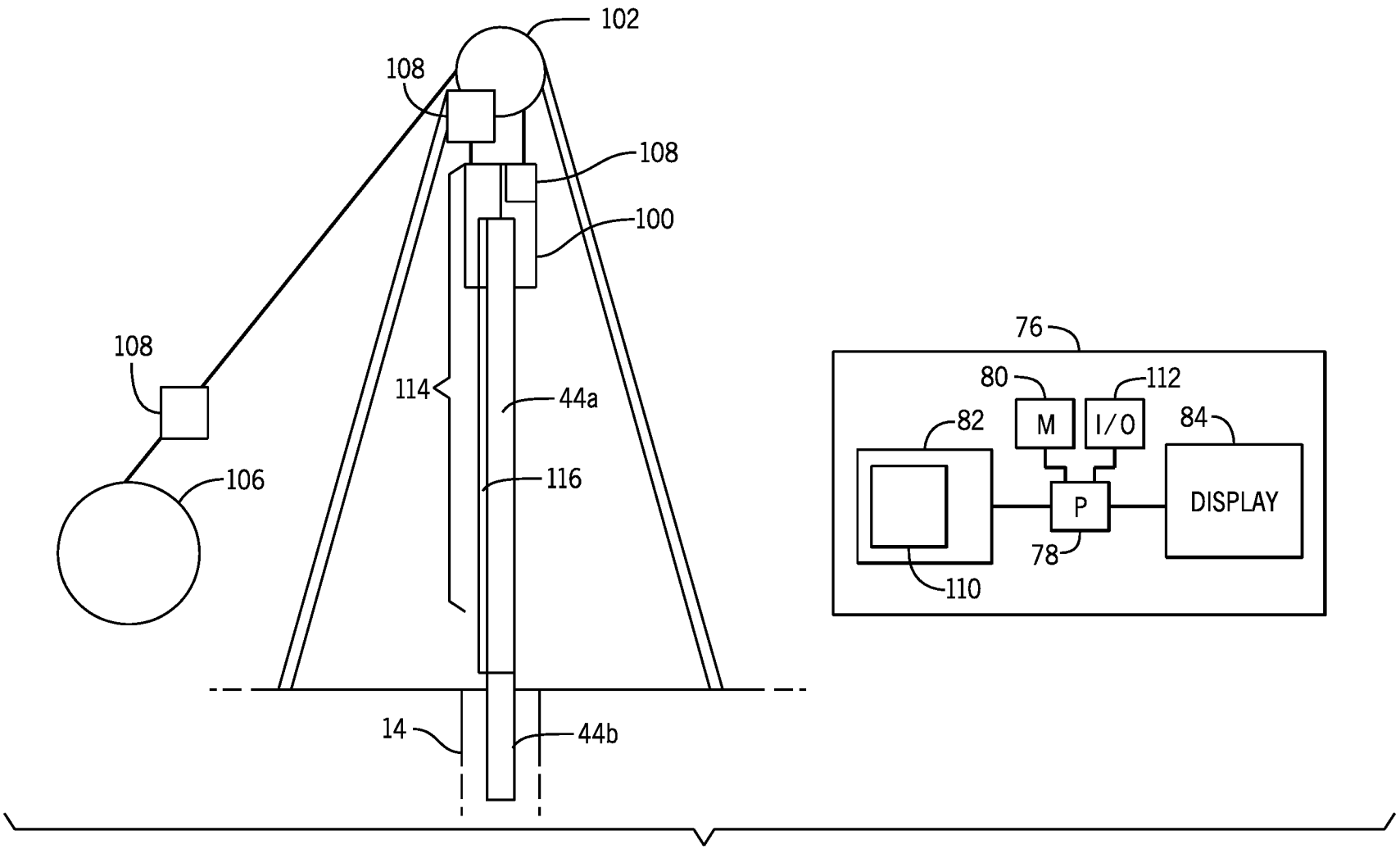
FIG. 6 is a schematic front elevation view of an embodiment of the drill rig of FIG. 1 at a second time point during tripping out of the drill string, in accordance with an embodiment of the present disclosure.

As also shown in the illustrated embodiment, the rig 10 includes one or more sensors 108. In general, the one or more sensors 108 measure motion of the components of the rig 10 (e.g., the traveling block 100) and/or a position of the drill bit (e.g., drill bit 18 as shown in FIG. 1) that may be used to determine whether one or more drill pipes were removed from the drill string, as discussed in more detail below with regard to FIGS. 8-12. For example, the one or more sensors 108 may be temperature sensors, accelerometers, gyroscopes, optical encoders (e.g., DRAWWORKS ENCODER), and the like. For example, at least one of the sensors 108 (e.g., 2 sensors, 3 sensors, 4 sensors, etc.) may be an optical encoder that measures a depth of the drill bit 18 and/or drill string 16. Additionally or alternatively, at least one of the sensors 108 may be a tension meter that measures a weight of a drill stem suspended from the hook 28. Several example positions of the sensors 108 are shown, but it should be noted that the one or more sensors 108 may be disposed on, in, or near other components of the rig 10. Each of the one or more sensors 108 may be communicatively coupled to the data processing system 76. That is, the processor 78 may receive data from the one or more sensors 108 and determine whether one or more drill pipes 44 were removed from the drill string 16. In some embodiments, the storage 82 of the data processing system 76 may include a drill pipe identification table 110 that includes information associated with one or more drill pipes of the drill string 16, as discussed in more detail with regard to FIG. 12. In some embodiments, the data processing system 76 may include an input/output (I/O) device 112 that an operator may interact with before, during, or after the tripping out process such as to modify, add, or remove data stored in the drill pipe identification table 110, receive alerts, receive an indication of a depth of the drill bit (e.g., drill bit 18), and the like, FIG. 6 is a front perspective view of an embodiment of the rig 10 at second time point after the drill pipe 44*a* has been removed from the wellbore 14. In the illustrated embodiment, the traveling block 100 has moved a longitudinal distance 114 from the wellbore 14. It should be noted that the first time point and the second time point may be associated of a distance traveled by one or more drill pipes within the wellbore 14, which may facilitate converting measurements obtained downhole, as discussed herein.

In operation, the sensors 108 may obtain a measurement indicative of motion of the traveling block 100 and/or a value of the longitudinal distance 114 traveled by the traveling block 100. As discussed in further detail with regard to FIGS. 11 and 12, the processor 78 may determine whether a drill pipe 44*a* and/or drill pipe 44*b* have been removed from the drill string 16 (not shown) based at least in part on the measurement. In some embodiments, the processor 78 may determine the length of the drill pipe 44*a* based on information stored in the drill pipe identification table 110 and/or the measurement. Further, in some embodiments, the processor 78 may store a time stamp associated with the removal of the drill pipe 44*a* from the drill string 16 (e.g., a time range and/or a first point of time associated with the drill pipe 44*a* being raised out of the wellbore and a second point of time associated with the drill pipe 44*b* being removed from the drill string). It should be noted that, at least in some instances, the longitudinal distance 114 traveled by the traveling block 100 may be proportional to (e.g., approximately equal to) the length of the drill pipe 44*a* and the length of the drill pipe 44*b*. Accordingly, the measurement may be indicative of two drill pipes (e.g., both the drill pipe 44*a* and the drill pipe 44*b* being removed from the drill string 16).

Figure 15:
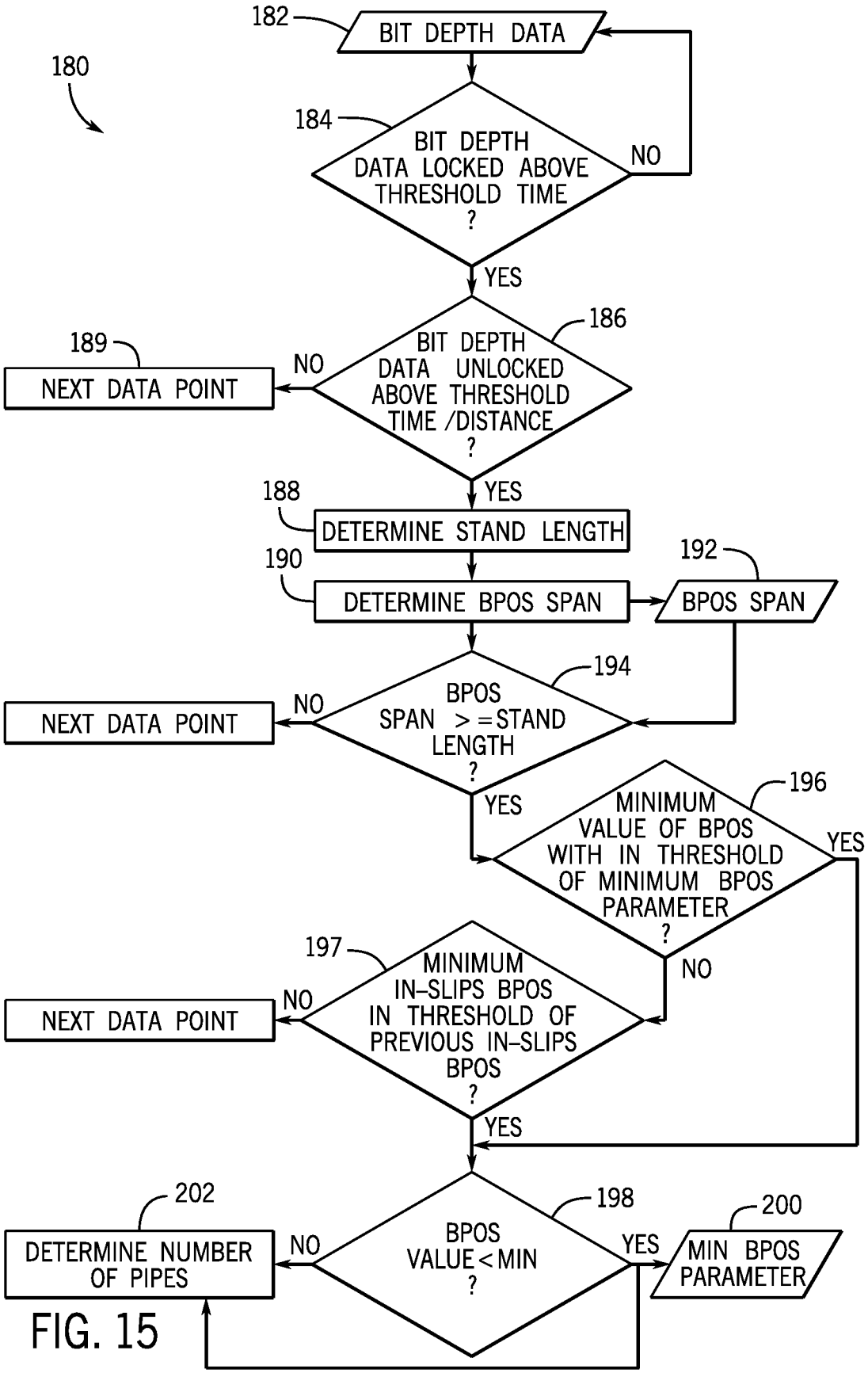
FIG. 15 is a flow chart representing an embodiment of a process for converting one or measurements as a function of time obtained by a well logging tool during logging-while-tripping (LWT) operations to one or more measurements as a function of position within a wellbore, in accordance with an embodiment of the present disclosure.

Further, as the sensors 108 may obtain measurements indicative of the drill pipe 44*a* being removed from the drill string 16, the sensors 108 may also obtain measurement indicative of the traveling block 100 returning to an initial position (e.g., a minimum block position), as generally discussed with regards to FIG. 15.

The data processing system 76, or any suitable processing system used during LWT operations, may use data stored in a drill pipe identification table to determine when one or more drills pipes 44 were removed from a drill string. FIG. 7 is an example of the drill pipe identification table 110 that may be accessed by the data processing system 76 to identify the one or more drill pipes 44 that were removed from the drill string 16 during LWT operations. The drill pipe identification table 110 may be stored in the memory 80 and/or storage 82 of the data processing system 76. In some embodiments, the drill pipe identification table 110 may be stored in any suitable memory accessible by the data processing system 76 (e.g., accessed via a cloud computing network). In some embodiments, the information stored in the drill pipe identification table 110 may be displayed on a suitable display (e.g., display 84) communicatively coupled to the data processing system 76. As discussed in more detail below, the drill pipe identification table 110 may be used by the data processing system 76 and/or receive includes by an operator associated with the drilling system (e.g., via I/O devices 112).

The illustrated embodiment of the drill pipe identification table 110 includes records 118 (e.g., rows) and fields 120 (e.g., columns) that display information associated with one or more drill pipes 44 of the drill string 16, such as a stand identification number 122, a pipe length 124, a tally depth 126, a bit depth 128, an offset 130, and a drift 132. In general, the stand identification number 122 indicates which stand corresponds to the drill pipes represented in the pipe length 124. The tally depth 126 includes reference data indicative of the depth of a drill pipe represented in the pipe length 124 relative to the first drill pipe. The bit depth 128 includes measurements received from the sensor(s) 108, The offset 130 and drift 132 represents an error between the bit depth 128 and the pipe length 124 and the tally depth 126. It should be noted that the information displayed in the drill pipe identification table 110 not meant to be limiting (e.g., some of the fields 120 may be removed and other fields may be added).

In operation, the data processing system 76 may generally access (e.g., retrieve data from and/or provide data to) the table to determine whether a stand break has occurred. For example, and as discussed in more detail with regard to FIGS. 11 and 12, the data processing system 76 may receive a measurement (e.g., movement data, tension data, weight data, or any combination thereof) from at least one sensor 108 and determine whether the measurement is indicative of at least one drill pipe of the one or more drill pipes 44 being removed from the drill string 16, "in-slips", "out-of-slips", and the like. Then, the data processing system 76 may identify the at least one drill pipe (e.g., a length associated with the at least one drill pipe) from the drill pipe identification table 110 based on the order at which the drill pipe 44 may be pulled out.

At least in some instances, the data processing system 76 may compare length information associated with the at least one drill pipe that is stored in the drill pipe identification table 110 to a length measured by the sensor 108 (e.g., an electronic data recorder (EDR) that may estimate a bit position, a sensor that receives measurements associated with a distance traveled by the traveling block 100). For example, the data processing system 76 may compare a received bit depth from the EDR that corresponds to a potential stand break and compare the received bit depth to a reference bit depth, such as a previously received bit depth that was determined to correspond to a stand break, which may be stored in the bit depth 128 field. The data processing system 76 may calculate a difference between the received bit depth and the reference bit depth and determined whether the difference corresponds to a length of one or more pipes. For example, as shown in the illustrated embodiment, a difference between two subsequent bit depths 128 is approximately equal to the sum of pipe lengths 124 in a corresponding stand identification number 122. In this way, and as discussed in more detail with regards to FIG. 15, the fields and records of the stand pipe identification table may facilitate identification of a stand break.

Figure 8:
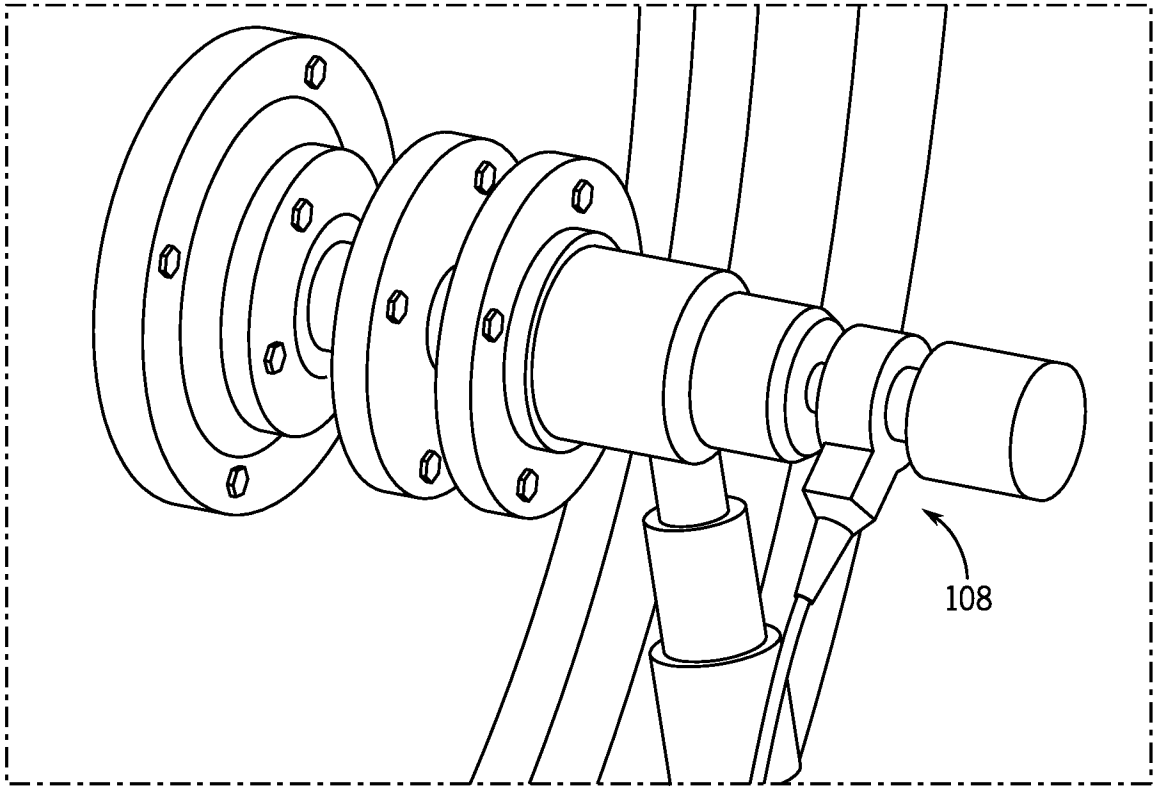
FIG. 8 is a schematic diagram of a sensor that may obtain measurements indicative of one or more drill pipes being removed from the drill string, in accordance with an embodiment of the present disclosure.

FIG. 8 shows a non-limiting example of an embodiment of a sensor 108 that may be used by the rig 10 in accordance with the present disclosure to determine when one or more drill pipes 44 are removed from a drill string 16. The sensor 108 be calibrated such that the sensor may output data indicative of a depth of the drill bit 18 as a function of time based on a rotational speed and direction of motion of the draw works 106. The data processing system 76 may use the data indicative of the depth of the drill bit 18 to determine when the one or more drill pipes are removed from the drill string 16 based on characteristics in the data. In some embodiments, the data processing system 76 may also determine when the one or more drill pipes are removed from the drill string 16 based on an additional set of data (e.g., characteristics of the additional set of data) obtained by a second sensor 108.

Figure 9:
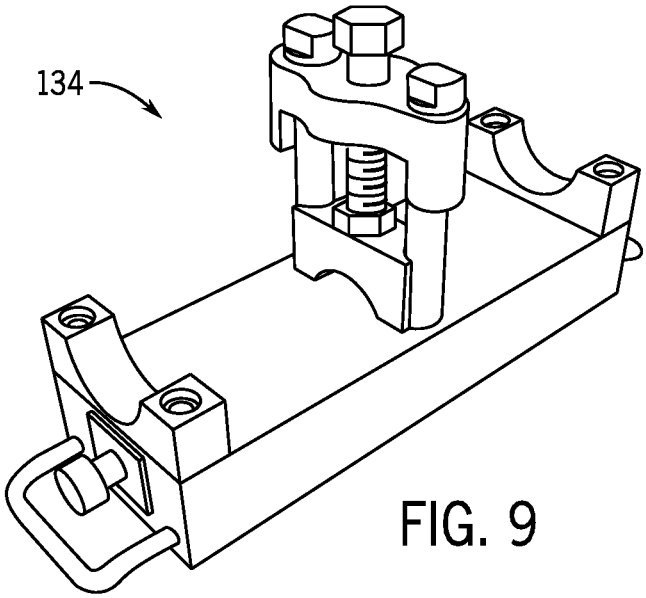
FIG. 9 is a schematic diagram of a tension meter that may obtain measurements indicative of one or more drill pipes being removed from the drill string, in accordance with an embodiment of the present disclosure.
Figure 10:
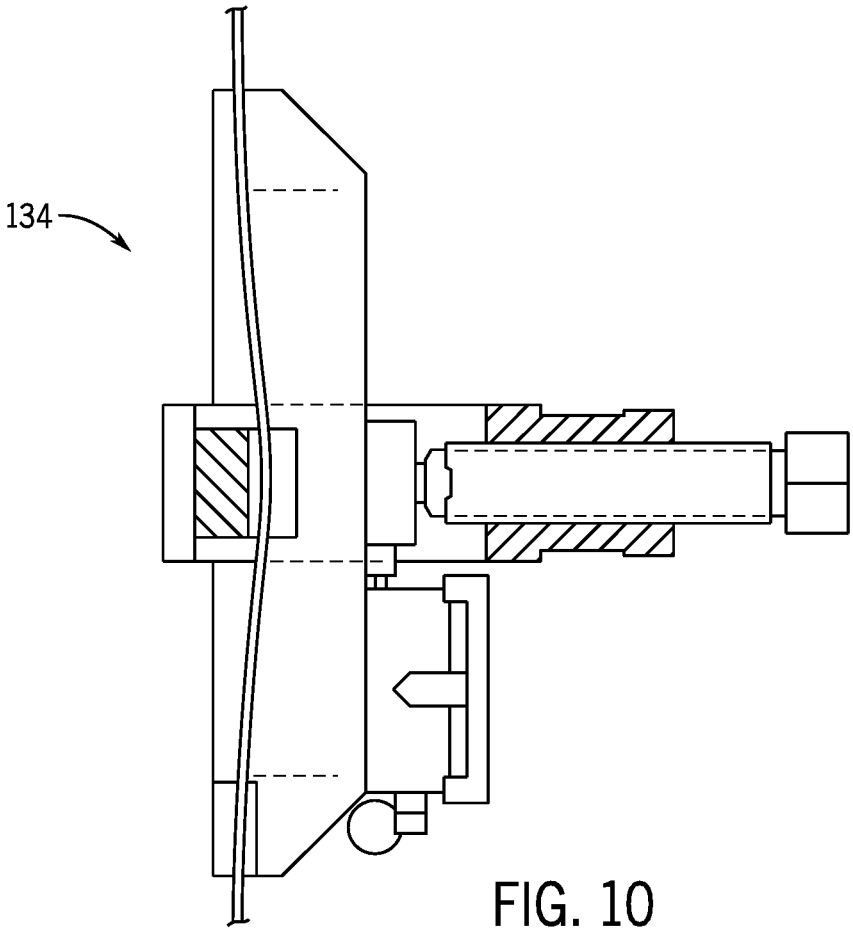
FIG. 10 is a schematic diagram of a cross-section of the tension meter shown in FIG. 9, in accordance with an embodiment of the present disclosure.
Figure 11:
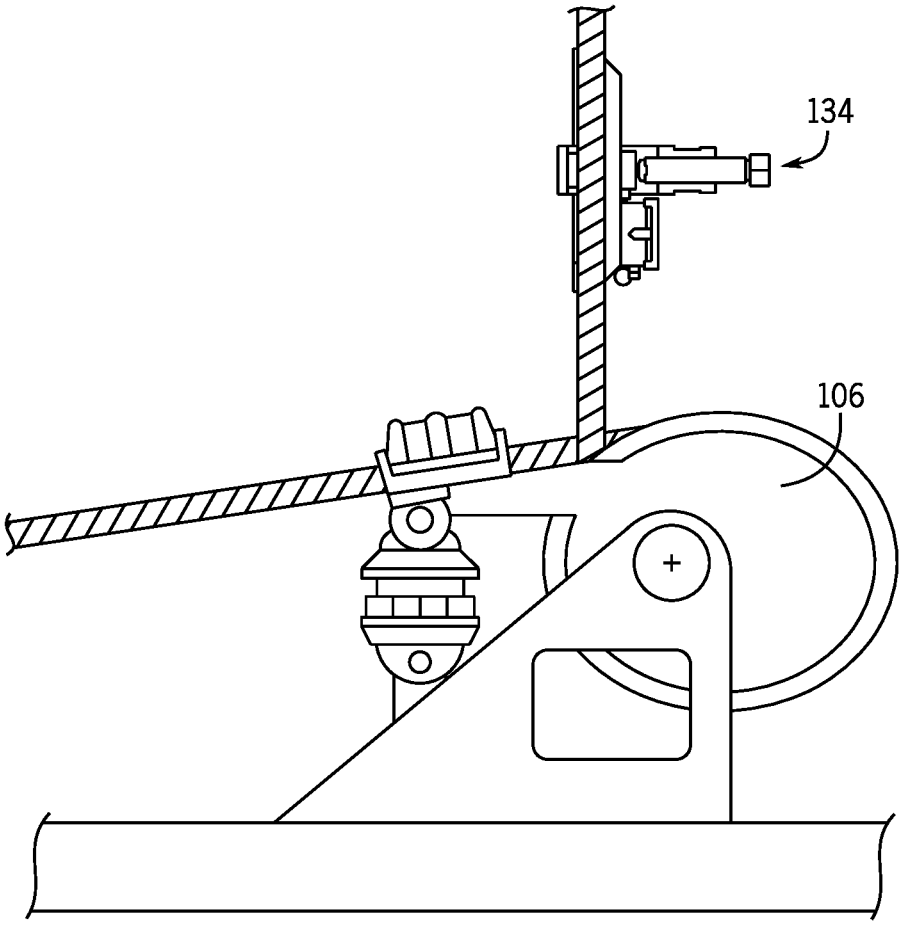
FIG. 11 is a schematic diagram of the tension meter disposed on components of a drill rig, in accordance with an embodiment of the present disclosure.

Additionally or alternatively, the sensor 108 may be a tension meter measure a weight of components that are suspended from the hook 28. For example, the sensor 108 may be mounted on the drill line above a deadline anchor. For illustrative purposes, FIGS. 9-11 show an example tension meter and example positions of the tension meter. For example, FIG. 9 shows a schematic diagram of a tension meter 134. As shown in FIG. 10, the tension meter 134 may be configured to receive the deadline. Moreover, as shown in FIG. 11, the tension meter 134 may be disposed near the draw works.

Figure 12:
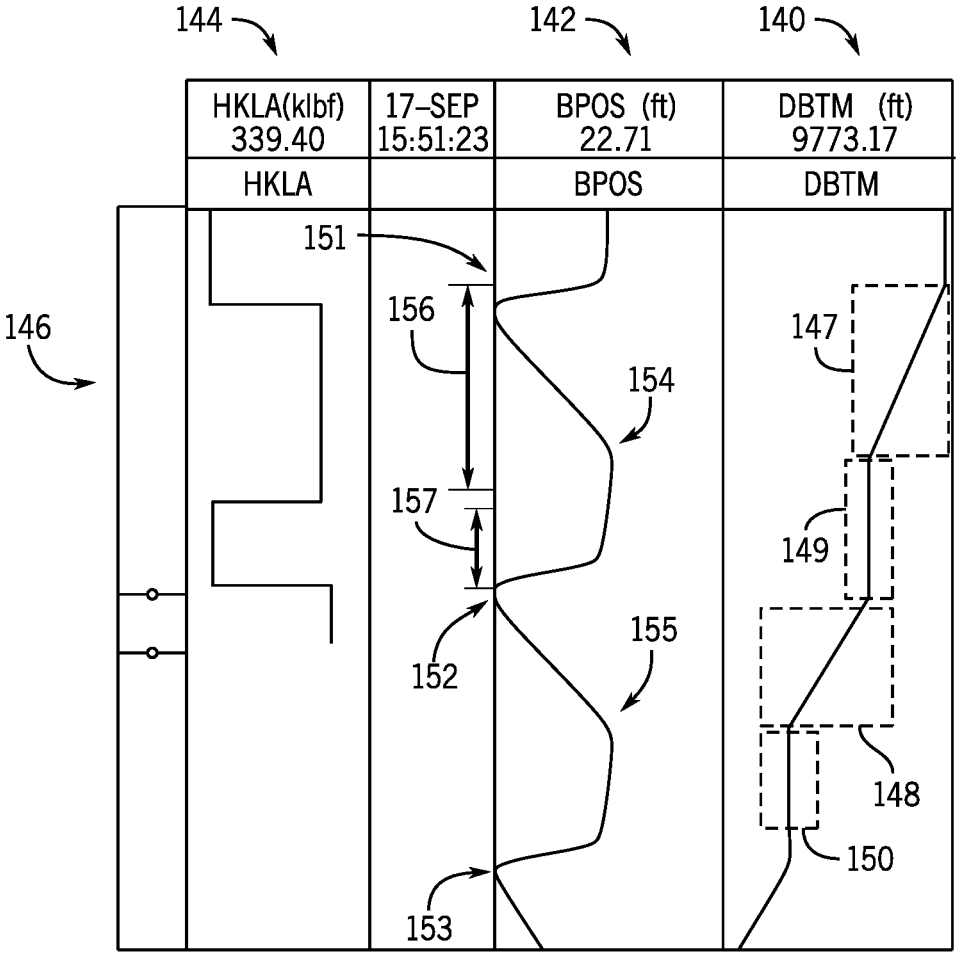
FIG. 12 shows three graphs that each depict a measurement obtained by a respective sensor of the drill rig, in accordance with an embodiment of the present disclosure.

With the foregoing in mind, FIG. 12 shows three graphs (e.g., graph 140, graph 142, and graph 144 that depict measured data obtained by three different sensors 108 plotted against time 146 as a non-limiting example of data obtained by multiple sensors 108 that may be used by the data processing system 76 to determine whether a stand break occurred. The graph 140 illustrates an estimated bit depth of the drill bit 18 measured by the embodiment of the sensor of FIG. 8, the graph 142 illustrates an estimated position of the traveling block 100 (e.g., measured by a sensor 108 disposed on or near the traveling block 100), and the graph 144 illustrates a measured hook load (e.g., hook 28). It should be noted that the measurements represented in the graphs are non-limiting examples of measurements that may be used in accordance with the techniques discussed herein.

In the illustrate embodiment, the line plotted in the graph 140 generally includes regions where the slope of the estimated drill depth versus time is non-zero (e.g., regions 147 and 148) and regions where the slope of the estimated drill depth versus time is approximately zero (e.g., as regions 149 and 150). When the slope of the line in graph 140 may indicate that the drill bit 18 is moving when the slope is greater than zero (e.g., above a movement threshold), or the slope of the line in graph 140 may indicate that the drill bit 18 is stationary when the slope is approximately equal to zero.

The graph 142 shows an estimated position of the traveling block 100, which may be measured by one or more of the sensors 108 discussed herein. The line depicted in the graph 142 generally oscillates between a minimum position and a maximum position, which may be indicative of the traveling block 100 traveling along the distance 114, as discussed above with regards to FIG. 6. For example, data points 151, 152, and 153 may correspond to a maximum position of the traveling block 100 (e.g., a sufficient height for removal of one or more drill pipes). Data points 154 and 155 may correspond to a minimum position of the traveling block 100. It should be noted that the minimum position (e.g., data points 154 and 155) may correspond to when the drill pipe(s) are being positioned "in-slips" and the maximum position (e.g., data points 151, 152, and 153) may correspond to when the drill pipe(s) are raised out of the wellbore 14 and/or removed. Furthermore, it should be noted that the regions (e.g., 156 and 157) that are between the maximum and minimum position (e.g., data points 151, 152, and 153) may be indicative of whether the drill pipe(s) 44 are "in-slips" or "out-of-slips," based on the generally shape and/or slope at one or more positions within the regions 156 and 157. As discussed in further detail with regards to FIG. 15, the data in the graphs 140 and 142 may be used in combination to determine an occurrence of a stand break. Moreover, in at least some instances, the data in the graph 144 may be used in combination with the graphs 140 and/or 142 to determine the occurrence of the stand break.

Figure 13:
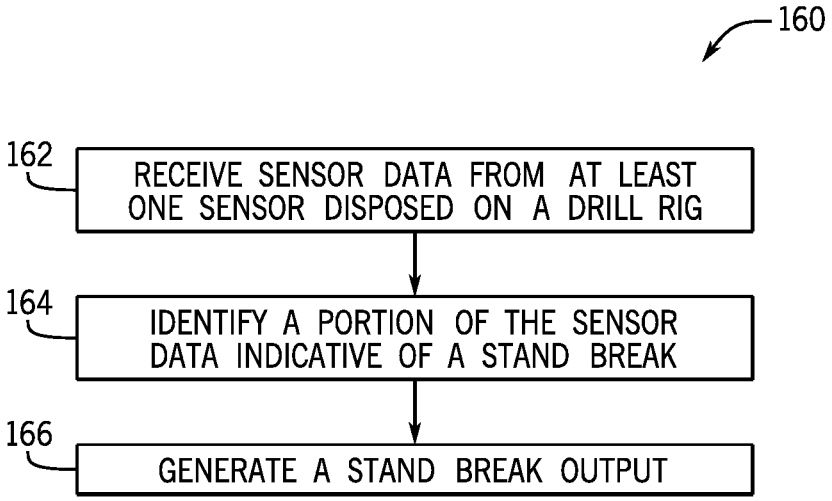
FIG. 13 is a flow chart representing an embodiment of a process for determining a stand break, in accordance with an embodiment of the present disclosure.

With the foregoing in mind, FIG. 13 is a flow diagram of a process 160 for identifying when one or more drill pipes 44 are removed from the drill string 16 and generating a stand break output. Although described in a particular order, which represents a particular embodiment, it should be noted that the process 160 may be performed in any suitable order. Additionally, embodiments of the process 160 may omit process blocks and/or include additional process blocks. Moreover, in some embodiments, the process 160 may be implemented at least in part by executing instructions stored in a tangible, non-transitory, computer-readable medium, such as memory 80, using processing circuitry, such as processor 78 implemented in the data processing system 76.

Generally, the process 160 includes receiving sensor data from at least one sensor disposed on a rig 10 (process block 162), identifying a portion of the sensor data indicative of a stand break (process block 164), and generating a stand break output (process block 166).

In block 162, the data processing system 76 (e.g., processor 78) may receive sensor data from the sensors 108 that are disposed on or near the traveling block 100, the draw works 106, or any other component of the rig 10 that moves in conjunction with the one or more drill pipes 44 being raised out of the wellbore 14. In some embodiments, such as when the processor 78 and/or an operator determines that sensor data from at least one sensor has a signal-to-noise ratio (SNR) is below a predetermined SNR threshold or the sensor data from the at least one sensor includes artifacts that may make it difficult to process the sensor data, the data may be smoothed by suitable methods as understood by one of ordinary skill in the art.

The process 160 also includes identifying a portion of the sensor data obtained by the at least one sensor 108 that is indicative of a stand break based at least in part on the sensor data (process block 164). For example, the processor 78 may determine the portion of the sensor data is indicative of a stand break when the sensor data 108 (e.g., the drill depth data depicted in graph 140) does not change after a threshold amount of time. Referring briefly to FIG. 12, the region 149 and/or region 150 may correspond to when the drill pipe(s) 44 are being positioned "in-slips." Additionally or alternatively, the processor 78 may use the data from the regions (e.g., region 148) occurring after the regions 149 and/or 150 to further confirm the presence of a stand break occurrence in the data. Furthermore, it should be noted that the BPOS data depicted in the graph 142 may be used alone or in combination with the drill depth data depicted in graph 140, by the processor, to determine an occurrence of a stand break, as discussed in more detail with regard to FIG. 15.

Additionally, the process 160 includes generating a stand break output based at least in part on the identified portion (process block 166). For example, the stand break output may be an alert that indicates a number of drill pipes 44 have been removed from the drill string (e.g., indicative that one or more drill pipes 44 have been removed and/or indicative of the number that have been removed. As a further non-limiting example, the stand break output may include data to be provided to the drill pipe identification able 110. In some embodiments, the stand break out may be a portion of data that corresponds to a length of pipes being raised out the wellbore e.g., within region 157). As a further non-limiting example, the stand break output may include a correction to a pipe tally. In this way, LWT operations nay be improved by reducing the amount of input provided by an operator during the operations, which may reduce costs associated with LWT operations.

Figure 14:
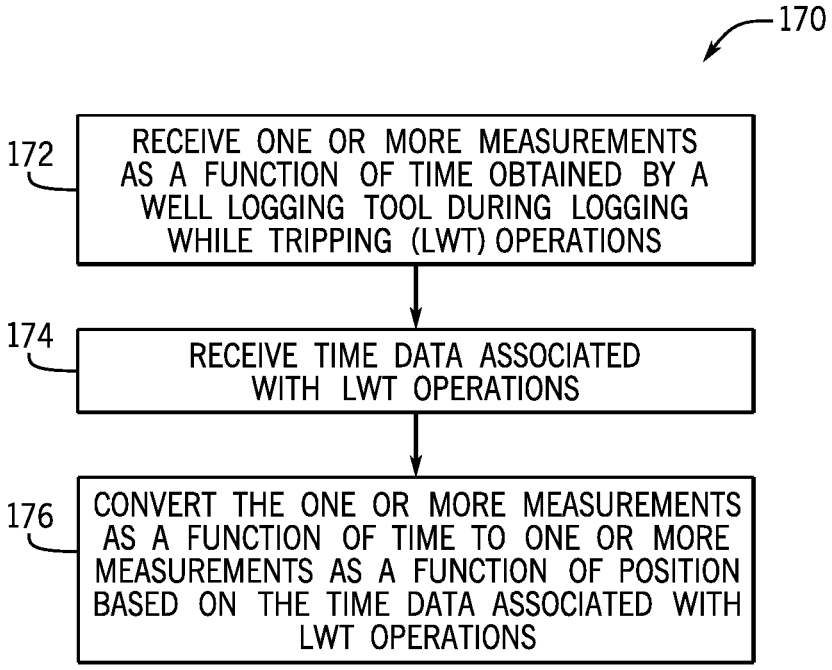
FIG. 14 is a flow chart representing an embodiment of a process for determining stand break and parameters related to the determined stand break, in accordance with an embodiment of the present disclosure.

With the foregoing in mind, FIG. 14 is a flow diagram of a process 170 for converting measurements as a function of time obtained by the well logging tool 42 to measurements as a function of position within the wellbore 14. Although described in a particular order, which represents a particular embodiment, it should be noted that the process 170 may be performed in any suitable order. Additionally, embodiments of the process 170 may omit process blocks and/or include additional process blocks. Moreover, in some embodiments, the process 170 may be implemented at least in part by executing instructions stored in a tangible, non-transitory, computer-readable medium, such as memory 80, using processing circuitry, such as processor 78 implemented in the data processing system 76.

Generally, the process 170 includes receiving one or more measurements as a function of time from a well logging tool 42 retrieved from a wellbore 14 during LWT operations (process block 172). In particular, and as discussed herein, the well logging tool 42 may be wireless such that the well logging tool 42 may not be able to communicate with computing devices at the surface during tripping out. Instead, the one or more measurements as a function of time may be stored in the memory 48 of the well logging tool 42, retrieved at the surface (e.g., via an operator), and subsequently processed using the steps discussed below.

The process 170 also includes identifying at least one stand break during the LWT operations (process block 174). For example, the stand break may be identified based on sensor data received by the sensors 108, as discussed above. In some embodiments, the identified stand break may include the stand break output from process 160. That is, the processor 78 may receive a stand break output that correlates a time period during the LWT operations with a length of one or more drill pipes that were removed from the drill string 16. Further, the process 170 includes converting the one or more measurements as a function of time to one or more measurements as a function of position within the wellbore 14 based at least in part on the identified stand break (process block 176). For example, the processor 78 may convert at least a portion of the one or measurements as a function of time associated with a time period that at least partially overlaps with the time period where one or more drill pipes 44 were removed from the drill string to one or more measurements as a function of position within the wellbore 14 using the length of the one or more drill pipes 44 that were removed. As generally discussed herein, it should be noted that process block 172 may occur after process block 174.

To further illustrate an embodiment of the techniques of the present disclosure, FIG. 15 is a flow diagram of a process 180 for determining a stand break based on sensor data from two sensors 108. In this process 180, the processor 78 may receive a first set of sensor data indicative of a bit depth position (e.g., bit depth data 182) and a second set of sensor data indicative of a position of the traveling block 100. To illustrate the process 180, the drill depth data depicted in graph 140 of FIG. 12 will be discussed in regards to the bit depth data 182, and the BPOS data depicted in graph 142 of FIG. 12 will be discussed in regards to the second set of sensor data. Although described in a particular order, which represents a particular embodiment, it should be noted that the process 180 may be performed in any suitable order. Additionally, embodiments of the process 180 may omit process blocks and/or include additional process blocks. Moreover, in some embodiments, the process 180 may be implemented at least in part by executing instructions stored in a tangible, non-transitory, computer-readable medium, such as memory 80, using processing circuitry, such as processor 78 implemented in the data processing system 76.

The process 180 generally includes receiving a first set of sensor data, such as bit depth data 182. Then, in decision block 184, the processor 78 may determine whether the bit depth data 182 is locked (e.g., stationary) for a time period longer than a threshold time (e.g., 5, 10, 20, 30, 60, 120 seconds, etc.). It should be noted that this may indicate that a drill pipe 44 is "in-slips," or held in place by suitable gripping tools while one or more operators and/or machines remove the drill pipe 44 from the drill string 16. For example, as discussed above with regards to FIG. 12, the processor 78 may identify the regions 147 and 148 based on a comparison of the slope of the line of graph 140 being within a threshold range (e.g., the slope does not change above 0.1%, 1%, 2%, 5%, and the like) over the threshold time.

After the processor 78 determines that the data included in the bit depth data 182 (e.g., regions 147 and/or 148) is indicative of the drill bit 18 being "in-slips" and/or remaining in a fixed position for a time period longer than the threshold time, the processor 78 may determine whether the bit depth data 182 has been unlocked above and/or below a threshold time and/or threshold distance (decision block 186), which may indicate whether the drill pipe(s) 44 being removed from the wellbore 14 are "out-of-slips." Referring to FIG. 12, the processor 78 may determine that the region 148 corresponds to the drill bit being unlocked or "out-of-slips" when the slope of the line is greater than and/or less than a threshold, and/or within a threshold range. It should be noted that this may correspond to the traveling block 100 returning from a maximum position (e.g., such that a length of drill pipe(s) may be removed from the wellbore 14) to the minimum position to receive a subsequent one or more length of drill pipes.

If the processor 78 determines that the bit depth data 182 has been unlocked above a threshold time and/or threshold distance, the processor 78 may determine a stand length based on the bit depth data 182 (process block 188). In some embodiments, the processor 78 may calculate the stand length based on a difference between a reference bit depth (e.g., previous "in-slips" bit depth) and the current bit depth (e.g., current "in-slips" bit depth). For example, the processor 78 may determine the current bit depth based on the value of the bit depth at region 150, and the processor 78 may determine the reference bit depth based on the value of the bit depth at region 149. In some embodiments, determining the reference bit depth may include the processor 74 accessing a record 118 in the drill pipe identification table 110 that includes the reference depth. Then, the processor 78 may determine the stand length based on the difference between the current bit depth and the reference bit depth.

In some embodiments, after determining the stand length, the processor 78 may determine whether the stand length (e.g., based on the current bit depth and the reference bit depth) is valid. For example, the processor may compare the stand length to a length of one or more drill pipes 44 to determine whether the stand length corresponds to a length of one drill pipe 44 or a length of multiple drill pipe 44 to confirm whether the determined stand length is valid. As such, it should be noted that this step may prevent incorrect determinations of stand lengths (e.g., false positives). In some embodiments, the lengths of the one or more drill pipes 44 may correspond to drill pipes that are expected to be below and/or above the current bit depth. Alternatively, the lengths of the one or more drill pipes may be a suitable reference length (e.g., an average pipe length 124). For example, turning briefly to the drill pipe identification table 110 of FIG. 7, if the stand length is approximately equal to 94.5 ft, then the processor 78 may determine that the stand length is valid because the stand length corresponds to a length of approximately three drill pipe lengths (e.g., as shown in the pipe length 124 field). Alternatively, if the processor 78 determines that the stand length is equal to 15.0 ft, then the processor 78 may determine that the stand length is invalid because the stand length is less than a length of one drill pipe. In some embodiments, if the processor 78 determines that the stand length is greater than a threshold length (e.g., 3, 4, 5, 6 lengths of drill pipes), the processor 78 may output an alert signal (e.g., a stand break out) that may inform an operator to monitor the stand break detection process (e.g., make a determination whether to halt the stand break detection process and/or proceed to manual stand break detection). In some embodiments, the alert signal may indicate a number of stand lengths that may have been skipped (e.g., based on the data stored in the drill pipe identification table 110.) In this way, the processor 78 may prevent erroneous stand breaks from being detected and being stored in the stand length identification table 110.

In block 190, the processor 78 may determine the block position span (BPOS) based on the second set of data in response to determining that the stand length is valid. For example, the processor 78 may determine a block position span 192 (e.g., a value of distance) based on the change in block position over the region 157. To further confirm the validity of a stand break associated with the determined stand length, the processor 78, in decision block 194, may compare the block position span 192 to the stand length determined in block 188 to determine whether the block position span 192 corresponds to a possible stand length of one or more drill pipes 44. If the BPOS span is greater than the stand length, then the processor 78 may determine that a stand break did not occur, and thus, move on to the next data point of bit depth data 182.

If the processor 78 determines that the block position span 192 corresponds to a possible stand length of one or more drill pipes 44, the processor 78, decision block 196, may then determine whether a minimum value of the block position span 192 is within and/or outside of a threshold range of a minimum block position parameter (e.g., 3 ft, 5 ft, 10 ft, etc.) In general, the minimum block position parameter is indicative of a minimum position of the traveling block 100 that the traveling block 100 returns to after one or more drill pipes 44 are removed and before one or more drill pipes are "in-slips." In some embodiments, the minimum block position parameter may be a value stored in memory and/or provided by an operator before and/or during the process 180 begins. For example, turning briefly to FIG. 12, the processor 78 may compare value of the block position corresponding to the data point 155, which may be indicative of the traveling block 100 returning to a minimum position, to the minimum block position parameter (e.g., provided by an operator). If the value of the block position corresponding to the data point 155 is within the threshold range of the minimum block position parameter, then the process 180 proceeds with block 198.

If yes, then the processor 78 may proceed to decision block 198 of the process 180 described in more detail below. For example, the memory 80 of the data processing system 76 may include data indicative of the initial position of the traveling block 100. In some embodiments, an operator may provide the initial position before or during the LWT operations. In any case, the minimum block position parameter general indicates the lowest position the traveling block 100 may reach during the LWT operations. As such, if the processor 78 determines that the minimum value of the block position span 188 is outside of the threshold range of the minimum block position parameter, this may indicate that the traveling block 100 may be too low (e.g., the drill pipe 44 may not be entirely out of the wellbore 14) or too high (e.g., a subsequent drill pipe is partially extending out of the wellbore 14). Thus, the minimum value of the block position span 188 may not correlate with a stand break and, as such, the processor 78 may move to the next data point 189 of the bit depth data 182.

If the processor 78 determines that the minimum value of the block position span 188 does not correspond to a possible stand length of one or more drill pipes, the processor may determine whether the current in-slips minimum (e.g., associated with the determination made in decision block 184) is within and/or outside of a threshold range of a previous in-slips minimum block position value (e.g., 1%, 5%, 10% of the length of the drill pipe 44) (decision block 197). Thus, the processor 78 may confirm whether the current in-slips minimum is indicative of the drill pipe 44 being in-slips, such as when the current in-slips minimum is within the threshold range. For example, the processor 78 may compare the block position corresponding to data point 155 to the block position corresponding to data point 154 (e.g., the previous in-slips BPOS). If the processor 78 determines that the block position corresponding to data point 155 is within a threshold range of the block position corresponding to the data point 154, the processor 78 may move to decision block 198. It should be noted that the determination in decision block 197 may enable the process 180 to be flexible for some drift in the measurements of the sensors 108 that may occur during the stand break detection process. If the processor 78 determines that the block position corresponding to the data point 155 is not within the threshold range of the block position corresponding to the data point 154, then the processor 78 may determine that this is not a valid stand break, and thus, move to the next bit depth data 182.

When the processor 78 determines that the minimum value of the block position span 188 is within of a threshold range of the minimum block position parameter, the processor may then compare the minimum value of the block position span 188 to the minimum block position parameter stored in the memory 80 (decision block 198). If the minimum value of the block position span 188 is less than the minimum block position parameter stored in the memory 80, the processor may replace the current minimum block position parameter with the minimum value 200 of the block position span 188 such that runs of the process 160 may use this new value. Then, the process 180 will continue with block 202.

When the processor 78 determines that the minimum value of the block position span is greater than the minimum block position parameter stored in the memory 80, the processor 78 may determine how many pipes are in the stand break and/or the length of pipes in the stand break. For example, the processor 78 may determine whether the current bit depth of the bit depth data 182 is indicative of 1, 2, 3, 4, 5, and 6 lengths of pipe and/or within a suitable error (e.g., approximately (1%, 2%, 5%, 10%, and the like) (process block 202).

In some embodiments, the processor 78 may also determine whether the bit depth data 182 is indicative of any errors that may occur during LWT operations. For example, if the bit depth data 182 received by the processor 78 does not change after a time threshold (e.g., 10 minutes, 15 minutes, 20 minutes, 30 minutes, etc.), the processor 78 may generate an alert and output the alert the display 84 and/or I/O device 112 of the data processing system. Additionally or alternatively, the processor 78 may also determine whether the processor 78 is receiving data from the sensors 108. Upon determination by the processor 78 that the processor 78 is not receiving data, the processor 78 may generate and/or output an alert. In some embodiments, the processor 78 may determine whether the bit depth moved greater than a threshold distance from the previous bit depth, which may indicate that the drill string 16 is being lowered too quickly. In this manner, the techniques of the present disclosure may reduce and/or prevent certain events from occurring during LWT operations.

Accordingly, the present disclosure relates to techniques for stand break detection and/or converting measurements as a function of time obtained during LWT operations to measurements as a function of position (e.g., depth) within the wellbore. In some embodiments, the techniques include identifying a stand break based on sensor data obtained by at least one sensor disposed on components of a rig. In some embodiments, the techniques include outputting a portion of the sensor data corresponding to drill pipes being raised out of the wellbore based on the identified stand break. Further, the techniques may include determining a length of the one or more drill pipes that are removed as well as converting one or more measurements as function of time (e.g., obtained by a well logging tool being removed from a wellbore by the tripping out system). For example, a processor may receive sensor data as a function of time obtained via one or more components of the tripping out system and determines characteristic features of the sensor data that are indicative of the one or more drill pipes being removed from the drill string. In some embodiments, the techniques include correlating a detected stand break to a length of one or more drill pipes that were removed from the drill string. Additionally, at least in some embodiments, the techniques include converting one or measurements as a function of time that were obtained during LWT operations into one or more measurements as a function of position based on the length of the one or more drill pipes that were removed. In this way, the techniques of the present disclosure may reduce the amount of input provided by operators and at least partially automate certain steps of the stand break detection process, which may reduce costs associated with LWT operations.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A system for stand break detection, comprising: a data processing system, wherein the data processing system comprises a processor configured to execute instructions stored in a memory of the data processing system to perform actions comprising: receiving measured movement data from at least one sensor associated with a component of a rig during a tripping process of a drill string having a plurality of drill pipes; and identifying a stand break associated with the drill pipes of the plurality of drill pipes based at least in part on the measured movement data, wherein the processor is configured to execute instructions stored in the memory of the data processing system to perform actions comprising: receiving an additional measured movement data from an additional sensor associated with an additional component of the rig during the tripping process; and identifying the stand break associated with the plurality of drill pipes of the plurality of drill pipes based at least in part on the additional measured movement data, wherein the processor is configured to execute instructions stored in the memory of the data processing system to perform actions comprising: identifying a first portion of the measured movement data, a second portion of the additional measured movement data, or both, corresponding to the plurality of drill pipes being moved through a wellbore based at least in part on the identified stand break; and determining a length of at least one of the plurality of drill pipes based at least in part on the first portion, the second portion, or both.

2. The system of claim 1, wherein the memory of the data processing system is configured to store a drill pipe identification table comprising length data associated with the plurality of drill pipes, and wherein the data processing system is configured to identify the stand break based at least in part on the drill pipe identification table.

3. The system of claim 2, wherein the processor is configured to execute instructions stored in the memory of the data processing system to perform actions comprising:

updating the drill pipe identification table based at least in part on the identified stand break.

4. The system of claim 1, wherein the at least one sensor comprises an optical encoder.

5. The system of claim 4, wherein the at least one sensor comprises a tension meter and the optical encoder.

6. The system of claim 1, wherein identifying the stand break is based at least in part on when the movement data is below a movement threshold for a predetermined time threshold.

7. The system of claim 1, wherein the component comprises a draw works, a drill line, a traveling block, or any combination thereof.

8. An article of manufacture comprising instructions that, when executed by at least one processor, cause the at least one processor to:

receive a first set of data obtained by a first sensor disposed on a first component of a rig during a tripping process, wherein the first set of data comprises data indicative of a traveling block position;

receive a second set of data obtained by a second sensor disposed on a second component of the rig during the tripping process, wherein the second set of data comprises data indicative of a position of a drill bit of the rig;

determine a stand length based at least in part on the second set of data; and determine a stand break based at least in part on a comparison between the first set of data and the determined stand length.

9. The article of manufacture of claim 8, comprising instructions that, when executed by at least one processor, cause the at least one processor to:

generate a corrected pipe tally based at least in part on the stand break.

10. The article of manufacture of claim 8, comprising instructions that, when executed by at least one processor, cause the at least one processor to:

identify a portion of the second set of data indicating that the position of the drill bit did not change for longer than a threshold time; and identify a maximum block position and a minimum block position in the first set of data associated with a first time period that is earlier that a second time period associated with the portion of the second set of data;

wherein the stand break is determined based at least in part on a comparison between the identified maximum block position and the identified minimum block position and the stand length.

11. The article of manufacture of claim 10, comprising instructions that, when executed by at least one processor, cause the at least one processor to:

determine a number of drill pipes tripped out of a wellbore associated with the rig based at least in part on the stand length in response to determining the stand break.

12. The article of manufacture of claim 10, comprising instructions that, when executed by at least one processor, cause the at least one processor to:

determine whether the identified minimum block position is less than a previous minimum block position; and in response to determining that the identified minimum block position is less than the previous minimum block position, output the identified minimum block position.

13. The article of manufacture of claim 10, comprising instructions that, when executed by at least one processor, cause the at least one processor to:

generate an alert indicating that the stand break did not occur based at least in part on the comparison between the identified maximum block position and the identified minimum block position and the stand length.

14. The article of manufacture of claim 13, wherein the alert comprises the determined stand length.

* * * * *